US008590615B2

(12) United States Patent
Stokka et al.

(10) Patent No.: US 8,590,615 B2
(45) Date of Patent: Nov. 26, 2013

(54) CASING DEVICE

(75) Inventors: Sigmund Stokka, Sandnes (NO); Bjarne Aas, Hommersak (NO)

(73) Assignee: Hole in One Producer AS (NO)

( * ) Notice: Subject to any disclaimer, the term of this patent is extended or adjusted under 35 U.S.C. 154(b) by 415 days.

(21) Appl. No.: 12/681,082

(22) PCT Filed: Oct. 15, 2008

(86) PCT No.: PCT/NO2008/000366

§ 371 (c)(1),
(2), (4) Date: Mar. 31, 2010

(87) PCT Pub. No.: WO2009/051490

PCT Pub. Date: Apr. 23, 2009

(65) Prior Publication Data

US 2010/0224358 A1 Sep. 9, 2010

(30) Foreign Application Priority Data

Oct. 16, 2007 (NO) ..... 20075283

(51) Int. Cl.
*E21B 23/00* (2006.01)

(52) U.S. Cl.
USPC ..... 166/119; 166/191; 175/263

(58) Field of Classification Search
USPC ..... 175/263–292, 406; 166/119, 127, 191
See application file for complete search history.

(56) References Cited

U.S. PATENT DOCUMENTS

| | | | | |
|---|---|---|---|---|
| 2,715,444 | A | 8/1955 | Fewel | |
| 4,095,655 | A * | 6/1978 | Still | 175/19 |
| 4,314,615 | A * | 2/1982 | Sodder et al. | 175/94 |
| 4,508,172 | A | 4/1985 | Mims et al. | |
| 5,547,029 | A | 8/1996 | Rubbo et al. | |
| 6,003,606 | A * | 12/1999 | Moore et al. | 166/381 |
| 6,286,603 | B1 | 9/2001 | Parent | |
| 6,431,291 | B1 | 8/2002 | Moore et al. | |
| 6,962,216 | B2 * | 11/2005 | Zupanick | 175/263 |
| 2006/0175061 | A1 | 8/2006 | Crichlow | |

FOREIGN PATENT DOCUMENTS

WO 94/29563 A1 12/1994

OTHER PUBLICATIONS

International Search Report for parent application PCT/NO2008/000366, having a mailing date of Feb. 24, 2009.

* cited by examiner

*Primary Examiner* — David Andrews
*Assistant Examiner* — Ronald Runyan
(74) *Attorney, Agent, or Firm* — Andrus, Sceales, Starke & Sawall, LLP

(57) ABSTRACT

A casing device for a borehole in the ground, in which an annulus is formed between the casing and the wall of the borehole, and in which the casing is provided with at least two packer groups, each including activatable packers, the packers being formed, in their active state, to seal the annulus, and at least one packer group of the activatable packers being connected to sliding sleeves, so that at least one group of packers is movable relative to the casing.

21 Claims, 3 Drawing Sheets

CASING DEVICE

CROSS-REFERENCE TO RELATED APPLICATIONS

This application is the U.S. national stage application of International Application No. PCT/NO2008/000366, filed Oct. 15, 2008, which International application was published on Apr. 23, 2009, as International Publication No. WO 2009/051490 A1 in the English language, which application is incorporated herein by reference. The International application claims priority of Norwegian Patent Application No. 20075283, filed Oct. 16, 2007, which application is incorporated herein by reference.

BACKGROUND

This invention relates to a casing. More particularly, it relates to a casing for a borehole in the ground, in which an annulus is formed between the casing and the wall of the borehole, and in which the casing is provided with at least two packer groups, each including activatable packers, the packers being formed, in their active state, to seal the annulus. At least one packer group of the activatable packers is connected to sliding sleeves, so that at least one group of packers is movable relative to the casing.

In drilling in the ground, as it is known from the recovery of petroleum, among other things, it is usual to run a casing into the ground. The main purposes of the casing are to stabilize the borehole and prevent liquid flow between the different zones of the well. For the latter to be achieved, the annulus between the casing and borehole is often filled with cement.

According to the prior art, drilling and the running-in of casing are most often carried out as separate operations, but it is also known to use a method in which a casing is inserted into the borehole during the drilling operation itself.

To penetrate, for example, a petroleum-bearing formation which is located relatively far from the drilling rig, and which may also extend over a considerable distance, it has become usual to drill approximately horizontal boreholes up to several kilometres long. These boreholes may also extend through several petroleum-bearing zones.

If the horizontal part of the well exceeds a certain length, it has turned out to be difficult to place casings into the well because of increasing frictional force in long horizontal wells. The weight of the part of the casing located in the approximately vertical part of the borehole may then be insufficient for moving the casing further into the approximately horizontal part of the borehole.

When drilling through more than one zone, or through a long zone, it can also be a challenge to stabilize the well in terms of pressure, as the different zones, or different parts of a long zone, may exhibit different pressures while, at the same time, it must be possible to supply sufficient drilling fluid to the borehole to ensure conveyance of cuttings via the annulus out of the borehole.

Thus, it may happen that drilling fluid is entering the formation in one zone, thereby damaging the formation with respect to subsequent production, while formation fluid is flowing out of another zone at the same time. The latter entails considerable drilling-technical problems. At worst the circumstance may result in an uncontrolled blow-out from the well and can also contribute to an uncased borehole wall caving in.

In shorter wells such problems are normally remedied by the cementation of a casing to the well wall in the problematic zone, and the well is drilled on from there with a somewhat smaller diameter than before. However, only a limited number of casings of successively smaller diameters can be placed in the well in this way. In relatively long wells this solution will often not be usable.

The invention has for its object to remedy or reduce at least one of the drawbacks of the prior art.

SUMMARY

The object is achieved according to the invention through the features which are specified in the description below and in the claims that follow.

A casing in accordance with the invention for a borehole in the ground, in which an annulus is formed between the casing and the wall of the borehole, and in which the casing is provided with at least two packer groups, each including activatable packers, the packers being formed, in their active state, to be able to seal the annulus, is characterized by at least one packer group of the activatable packers being connected to sliding sleeves, so that at least one group of packers is movable relative to the casing.

The packer groups may be constituted by a first packer group including packers which are movable relative to the casing, and a second packer group including packers which are fixed relative to the casing.

Preferably, the packers belonging to the first and second packer groups are distributed alternatingly along the length of the casing, the inter-package distance being determined with a view to the distance between the zones of the formation and the displacement force necessary for pulling the casing into the borehole.

It is advantageous that the packers are arranged in packer pairs along the casing, at least one packer of each packer pair being mounted on a sliding sleeve which is movable relative to the casing.

By means of actuators, the first packer group, in which the packers are connected to their respective sliding sleeves, is arranged to be moved along the casing. When the packers of the first packer group are deactivated while, at the same time, the packers of the second packer group, which is activated, are sealing the annulus and securing the casing within the borehole, the packers of the first packer group can be moved relative to the casing and borehole.

Next, the packers of the first packer group are activated while the packers of the second packer group are deactivated. The casing can thereby be moved inwards in the borehole while, at the same time, the flow of liquid along the casing via the annulus is substantially prevented.

By providing the casing with two packer groups in this way, different zones along the borehole may be kept sealed off from each other during drilling and during movement of the casing in the borehole.

The actuators which move the sliding sleeves relative to the casing may be of any known design, but because of the relatively great forces required for a casing up to several kilometres long to be moved in an approximately horizontal borehole, hydraulic actuators are preferred.

With advantage, the actuators are provided with a control system, by which they are supplied with pressure fluid from the surface via pipelines or conduits which are embedded in the casing wall or which are positioned in a cavity between two casings, if a double casing is used. In practice it is the most advantageous to provide the casing with a pressure conduit and a return conduit for hydraulic fluid to the actuators and packers.

Preferably, the activation and deactivation of the packers are carried out by means of hydraulic fluid carried via the pipelines or conduits.

Electric wires have also been extended for the control of valves and for signal transmission between the casing and the surface.

Each actuator and packer is controlled by a valve, and the valves may be controlled individually or in groups from the surface. The valves may be provided with mutually sequential functions, that is to say that, for example, a valve for the moving of a packer is activated when the packer is disengaged.

In principle, all the packers may be movable relative to the casing, but this is unnecessary and uneconomical. It is sufficient that the packers of one of the packer groups are movable for the sufficient effect to be achieved.

With advantage, the casing is provided with a drilling head at its free end portion. The drilling head includes a drill bit and a motor. The motor may be driven, in a manner known per se, by the drilling fluid. The drilling head is typically formed with its own traction device which is arranged to move the drill bit relative to the casing.

In this way, drilling and subsequent movement of the casing may alternate. However, a nearly continuous subsequent movement of the casing is also conceivable.

The drilling head may also include sensors to determine the direction of the drilling which is going on. The drilling direction of the drill bit relative to the axis of the casing can be controlled by means of techniques known per se. This may be controlled and adjusted, in a manner known per se, from the surface. Thereby the direction of the well path may be adjusted during the drilling.

The drill bit may be provided with a reamer ("hole opener") to increase the diameter of the borehole.

The drilling head may be arranged to be moved, in a manner known per se, to the surface for maintenance and possible replacement of the drill bit. In that case the reamer must be collapsible for the drilling head to be able to pass through the casing. According to the prevailing conditions, differential pressure or connection to a cable, coiled tubing or drill pipe can be used to move the drilling unit to and from the surface.

Various further sensors can be placed near the drilling head and along the casing in order to perform continuous formation testing as the drilling progresses.

Along the casing may be arranged valves which can be used in the completion phase if it is desirable to cement the annulus between the casing and well wall in zones of the well.

For later use in the production phase it is advantageous that the part of the casing which is finally placed in the producing formation is provided with one or more activatable valves or ports which are arranged to control the liquid flow between the annulus and casing. The casing may with advantage also be provided with other completion equipment, such as sand screens covering these inflow ports.

For use in the production phase it will also be useful to have placed sensors in the producing zone, for example pressure and temperature gauges and meters for the liquid flow through the different inflow ports.

The casing gets pipe lengths added to it during the drilling operation. The pipe lengths may be connected to each other by means of threaded connections or different known quick-release couplings.

The invention enables the running-in of a casing in a relatively long, approximately horizontal borehole while, at the same time, different formation zones in the well are kept closed and separate. The casing is arranged to be run into the borehole concurrently with the drilling operation.

BRIEF DESCRIPTION OF THE DRAWINGS

In what follows there is described an example of a preferred embodiment which is visualized in the accompanying drawings, in which.

DETAILED DESCRIPTION OF THE DRAWINGS

Figure 1:
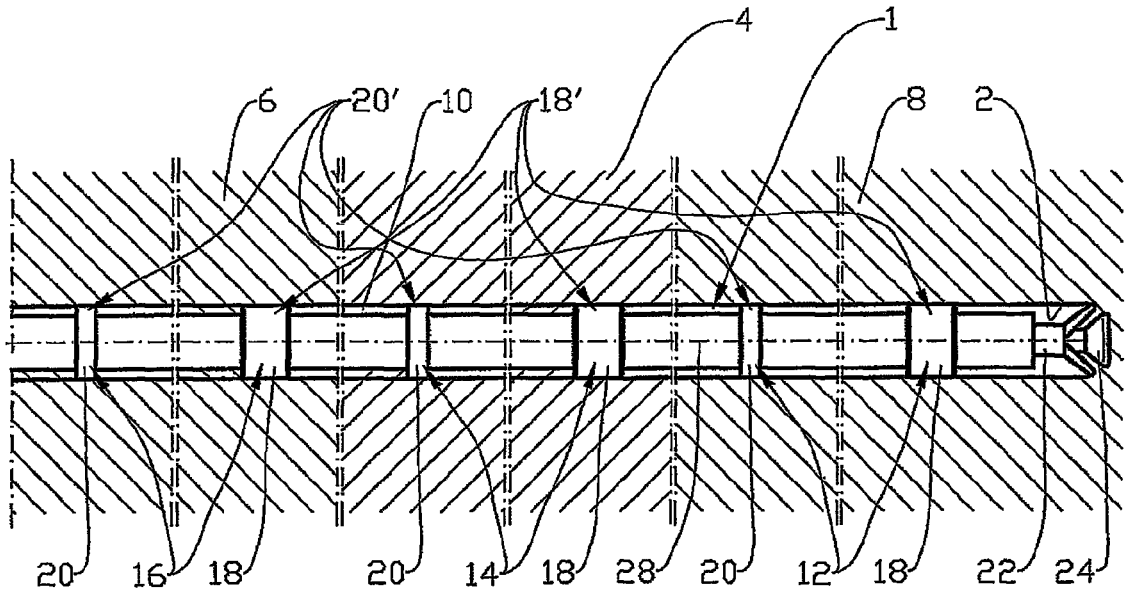
FIG. 1 shows schematically a casing in accordance with the invention, the casing being in a borehole in a formation which includes several zones.

In the drawings the reference numeral 1 indicates a casing which is positioned in a borehole 2 in a formation 4, the formation 4 including a first petroleum-bearing zone 6 and a second petroleum-bearing zone 8. An annulus 10 is formed between the casing 1 and the wall of the borehole 2.

The casing 1 is provided with a first packer pair 12, a second packer pair 14 and a third packer pair 16. The packer pairs 12, 14, 16 each include a first packer 18, movable relative to the casing 1, and a second packer 20, fixed relative to the casing 1. The movable first packers 18, form a first packer group 18' and the fixed packers 20, form a second packer group 20'.

A drilling head 22, which includes a drill bit 24, is arranged at the free end portion of the casing 1. The centre axis of the drill bit 24 may be tilted, in a manner known per se, relative to the centre axis 28 of the casing 1 for directional control of the direction of drilling. Alternatively, the directional control may be carried out by means of other known techniques.

Figure 2:
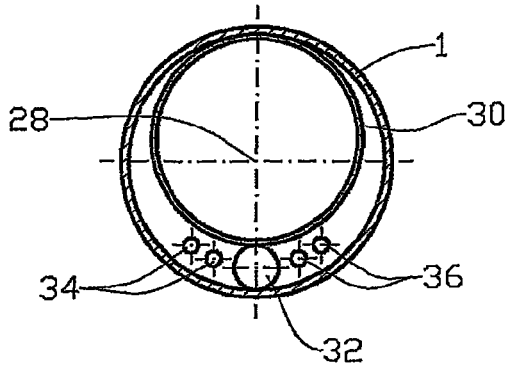
FIG. 2 shows schematically, on a larger scale, a section through the casing.

With advantage, the casing 1 may be provided with an inner casing 30, see FIG. 2, there being, between the two casings, a return pipe 32 for drilling fluid containing cuttings, electrical cables 34 and hydraulic conduits 36. Of the hydraulic conduits 36 at least one is provided, in a manner known per se, with a higher pressure than the rest of the hydraulic conduits 36.

Figure 3:
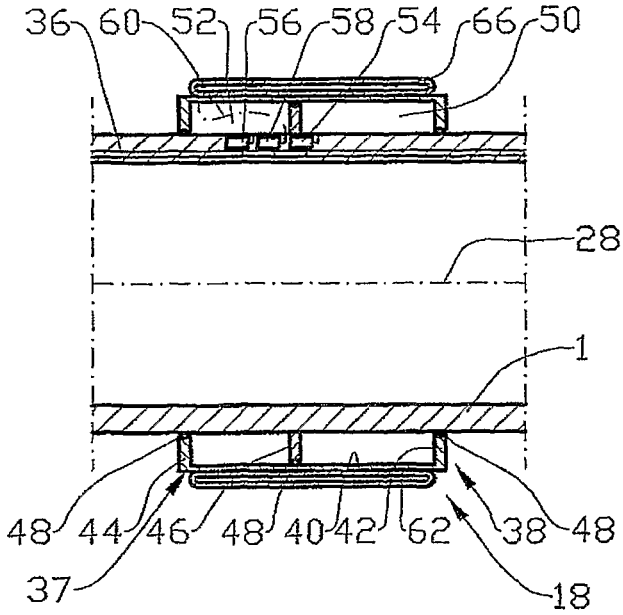
FIG. 3 shows schematically, on a larger scale, a packer which is mounted on a sliding sleeve.

The movable first packer 18 is mounted on a sliding sleeve 37, see FIG. 3. An actuator 38, which is arranged to move the sliding sleeve 37 with the packer 18 along the casing 1, is built into the sliding sleeve 37. The sliding sleeve 37 includes a movable cylinder tube 40 which is provided, at one end portion, with a first end wall 42 and which is provided, at its opposite end portion, with a second end wall 44. In this preferred embodiment, the sliding sleeve 37 is constituted by the cylinder tube 40 and the end walls 42 and 44.

A piston 46 fitting complementarily in the cylinder tube 40 is fixed to the casing 1. Seals 48 prevent leakage past the piston 46 and end walls 42, 44. It may be advantageous for the seals 48 to be of such form that they provide a minor leakage of hydraulic fluid past the end walls 42, 44 so as to clean the sliding surfaces of particles from outside.

A first cylinder chamber 50 is formed between the casing 1, cylinder tube 40, first end wall 42 and piston 46, whereas a second cylinder chamber 52 is formed between the casing 1, cylinder tube 40, second end wall 44 and piston 46.

A first control valve 54, a second control valve 56 and a third control valve 58 convey, in a manner known per se, hydraulic fluid to and from the hydraulic conduits 36 into respectively the first cylinder chamber 50, the second cylinder chamber 52, and via a flexible tube 60 into the cavity 62 of the movable first packer 18.

Figure 5:
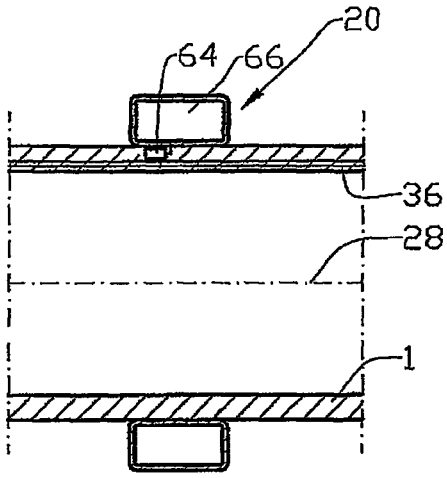
FIG. 5 shows schematically a packer which is fixedly connected to the casing.

A fourth control valve 64 conveys hydraulic fluid to and from the cavity 66 of the fixed packer 20, see FIG. 5.

Figure 6:
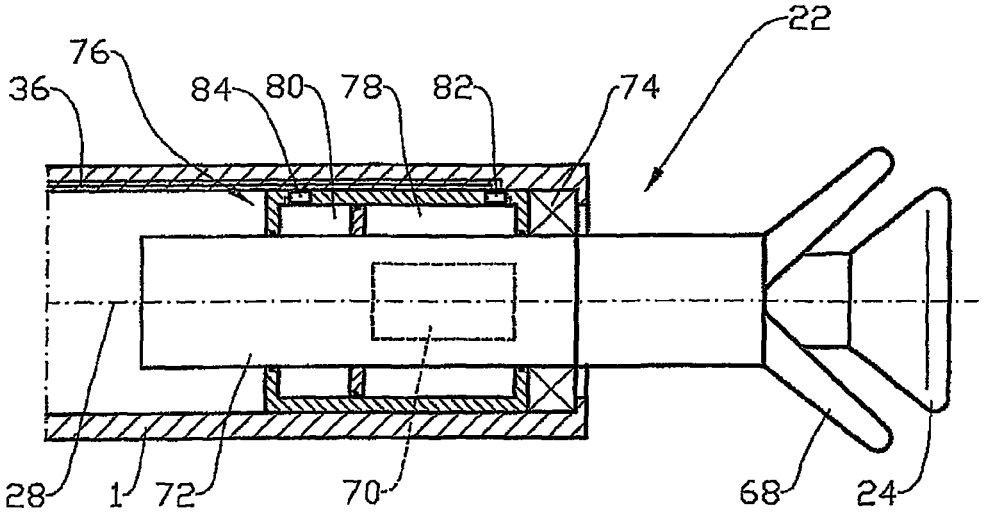
FIG. 6 shows schematically a drilling device which is arranged at the end portion of the casing.

The drilling head 22, see FIG. 6, includes, besides the drill bit 24, a collapsible reamer 68 known per se. The drill bit 24 and reamer 68 are driven about the centre axis 28 by a drill-fluid-operated motor 70 which is positioned in the housing 72 of the drilling head 22.

During drilling, the drilling head 22 is locked to the casing 1 by means of a releasable locking device, known per se, not shown.

A hydraulic feeding device 76, which is arranged to move the drilling head 22 axially relative to the casing 1, includes a third cylinder chamber 78 and a fourth cylinder chamber 80. The feeding device 76 corresponds functionally to the actuator 38 and is not described any further. A fifth control valve 82 and a sixth control valve 84 convey hydraulic fluid to and from the hydraulic conduits 36 into the third cylinder chamber 78 and into the fourth cylinder chamber 80, respectively.

The drilling head 22 may be arranged to be moved, by means of techniques known per se, to and from the surface via the casing 1 or the inner casing 30 after the reamer 68 has been collapsed.

All the control valves 54, 56, 58, 64, 82, 84 are controlled via the cables 34 from the surface. The design and positioning of the control valves 54, 56, 58, 64, 82, and 84 will vary with the design of the other components. For example, it may be appropriate to replace the first and second control, valves 54, 56 with a five-way valve or valve block, not shown.

When the sliding sleeve 37 with the packer 18 is to be moved relative to the casing 1, the third control valves 58 are operated to open to the return of fluid from the cavities 62 of the movable first packers 18, whereby the pressure from the movable packers 18 against the wall of the borehole 2 is relieved.

The first control valves 54 are operated to open to pressure fluid to the first cylinder chamber 50, while the second control valve 56 is operated at the same time to allow fluid to be drained from the second cylinder chamber 52. The actuator 38 thereby moves the sliding sleeve 37 with the first packer 18 along the casing 1 in the direction of the free end portion of the casing 1.

When the actuator 38 is in its end position the third control valves 58 are shifted, thereby supplying hydraulic fluid to the cavities 62 of the movable first packers 18. Thereby the movable first packers 18 are extended sealingly against the wall of the borehole 2.

By shifting of the fourth control valves 64, hydraulic fluid is evacuated from the cavities 66 of the fixed second packers 20, whereby the fixed second packers 20 are disengaged.

Figure 4:
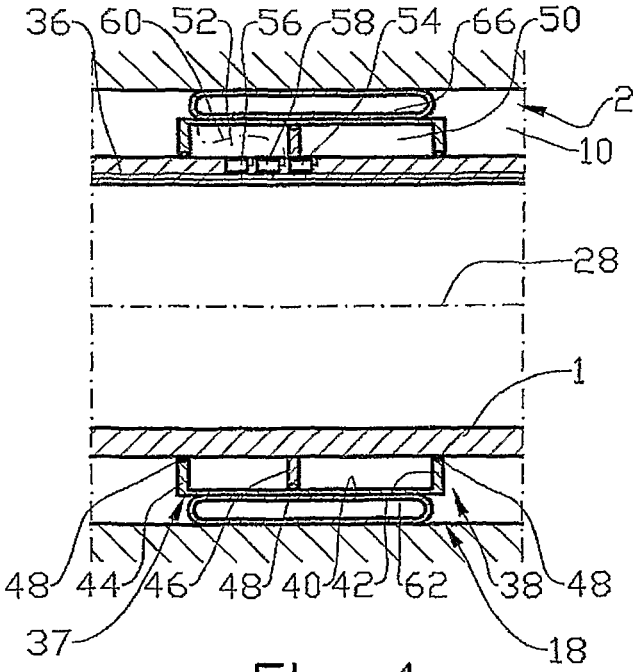
FIG. 4 shows the packer of FIG. 3 in the active state in a borehole.

By the first control valve 54 and the second control valve 56 being brought to shift, the first cylinder chamber 50 is evacuated as hydraulic fluid simultaneously enters the second cylinder chamber 52. The movable packer 18, which is now fixed, holds the sliding sleeve 37 stationary relative to the formation 4, whereas the pistons 46 move the casing 1 inwards in the borehole 2, see FIG. 4.

The operation may be repeated until the casing 1 is in the desired position in the borehole 2. By performing the operation in the reverse order, the casing 1 can be moved in the direction out of the borehole 2.

When drilling fluid is supplied to the motor 70, the drill bit 24 and reamer 68 are brought to rotate about the centre axis 28.

When the fourth cylinder chamber 80 is supplied with fluid via the sixth control valve 84 while, at the same time, the third cylinder chamber 78 is evacuated by means of the fifth control valve 82, the drill bit 24 and reamer 68 are moved towards the bottom portion of the borehole 2 while the casing 1 is held stationary by means of the movable first and fixed second packers 18, 20.

Drilling fluid flows together with cuttings via the return pipe 32 to the surface.

The invention claimed is:

1. A system for drilling and completing an underground borehole extending through a plurality of petroleum-bearing formation zones, the system comprising:

a production casing axially extending in the borehole and containing production equipment for producing petroleum from the plurality of petroleum-bearing formation zones;

first and second packers on the production casing, both the first and second packers being selectively radially expandable away from the production casing to thereby seal an annulus between the production casing and the borehole so as to prevent flow of production fluid therepast, both the first and second packers further being selectively radially contractible towards the production casing to unseal the annulus and thereby allow flow of production fluid therepast;

the first and second packers being axially spaced apart from each other along the production casing such that a portion of the annulus extends therebetween, and at least the first packer being connected to a sliding sleeve that is disposed on the production casing, the sliding sleeve and the first packer being axially movable together along the production casing;

wherein the production casing comprises a downhole end, the system further comprising a drilling head that carries out drilling of the underground borehole, the drilling head being located at the downhole end of the production casing; and an inner casing disposed inside the production casing and a return pipe between the inner casing and the production casing, the return pipe carrying drilling fluid associated with the drilling head.

2. A system according to claim 1, wherein the second packer is fixed to the production casing.

3. A system according to claim 2, wherein the first and second packers constitute a first pair of packers and further comprising third and fourth packers that together constitute a second pair of packers, the second pair of packers being spaced apart from the first pair of packers along the length of the production casing; both the third and fourth packers being selectively radially expandable away from the production casing to thereby seal an annulus between the production casing and the borehole so as to prevent flow of production fluid therepast, both the third and fourth packers further being selectively radially contractible towards the production casing to unseal the annulus and thereby allow flow of production fluid therepast; wherein the third and fourth packers are axially spaced apart from each other along the production casing such that another portion of the annulus extends therebetween and wherein at least the third packer is connected to a sliding sleeve that is disposed on the production casing, the sliding sleeve and the third packer being axially movable together along the production casing.

4. A system according to claim 1, wherein the sliding sleeve comprises a movable cylinder tube having a first end wall and a second end wall.

5. A system according to claim 4, further comprising a piston disposed in the cylinder tube and fixed to the production casing.

6. A system for drilling and completing an under round borehole extending through a plurality of petroleum-bearing formation zones, the system comprising:

a production casing axially extending in the borehole and containing production equipment for producing petroleum from the plurality of petroleum-bearing formation zones;

first and second packers on the production casing, both the first and second packers being selectively radially expandable away from the production casing to thereby seal an annulus between the production casing and the borehole so as to prevent flow of production fluid therepast, both the first and second packers further being selectively radially contractible towards the production casing to unseal the annulus and thereby allow flow of production fluid therepast;

the first and second packers being axially spaced apart from each other along the production casing such that a portion of the annulus extends therebetween, and at least the first packer being connected to a sliding sleeve that is disposed on the production casing, the sliding sleeve and the first packer being axially movable together along the production casing;

wherein the second packer is fixed to the production casing;

wherein the first and second packers constitute a first pair of packers and further comprising third and fourth packers that together constitute a second pair of packers, the second pair of packers being spaced apart from the first pair of packers along the length of the production casing; both the third and fourth packers being selectively radially expandable away from the production casing to thereby seal an annulus between the production casing and the borehole so as to prevent flow of production fluid therepast, both the third and fourth packers further being selectively radially contractible towards the production casing to unseal the annulus and thereby allow flow of production fluid therepast; wherein the third and fourth packers are axially spaced apart from each other along the production casing such that another portion of the annulus extends therebetween and wherein at least the third packer is connected to a sliding sleeve that is disposed on the production casing, the sliding sleeve and the third packer being axially movable together along the production casing;

wherein the production casing comprises a downhole end, the system further comprising a drilling head that carries out drilling of the underground borehole, the drilling head being located at the downhole end of the production casing; and an inner casing disposed inside the production casing and a return pipe between the inner casing and the production casing, the return pipe carrying drilling fluid associated with the drilling head.

7. A system for drilling and completing an underground borehole extending through a plurality of petroleum-bearing formation zones, the system comprising:

a production casing axially extending in the borehole and containing production equipment for producing petroleum from the plurality of petroleum-bearing formation zones;

first and second packers on the production casing, both the first and second packers being selectively radially expandable away from the production casing to thereby seal an annulus between the production casing and the borehole so as to prevent flow of production fluid therepast, both the first and second packers further being selectively radially contractible towards the production casing to unseal the annulus and thereby allow flow of production fluid therepast;

the first and second packers being axially spaced apart from each other along the production casing such that a portion of the annulus extends therebetween and at least the first sacker being connected to a sliding sleeve that is disposed on the production casing, the sliding sleeve and the first packer being axially movable together along the production casing;

wherein the second packer is fixed to the production casing;

wherein the first and second packers constitute a first pair of packers and further comprising third and fourth packers that together constitute a second pair of packers, the second pair of packers being spaced apart from the first pair of packers along the length of the production casing; both the third and fourth packers being selectively radially expandable away from the production casing to thereby seal an annulus between the production casing and the borehole so as to prevent flow of production fluid therepast, both the third and fourth packers further being selectively radially contractible towards the production casing to unseal the annulus and thereby allow flow of production fluid therepast; wherein the third and fourth packers are axially spaced wart from each other along the production casing such that another portion of the annulus extends therebetween and wherein at least the third packer is connected to a sliding sleeve that is disposed on the production casing, the sliding sleeve and the third packer being axially movable together along the production casing;

wherein the production casing comprises a downhole end, the system further comprising a drilling head that carries out drilling of the underground borehole, the drilling head being located at the downhole end of the production casing; and at least one of electrical cables and hydraulic conduits disposed between the inner casing and the production casing, at least some of the at least one of the electrical cables and the hydraulic conduits being connected to the drilling head.

8. A system for drilling and completing an underground borehole extending through a plurality of petroleum-bearing formation zones, the system comprising:

a production casing axially extending in the borehole and containing production equipment for producing petroleum from the plurality of petroleum-bearing formation zones;

first and second packers on the production casing, both the first and second packers being selectively radially expandable away from the production casing to thereby seal an annulus between the production casing and the borehole so as to prevent flow of production fluid therepast, both the first and second packers further being selectively radially contractible towards the production casing to unseal the annulus and thereby allow flow of production fluid therepast;

the first and second packers being axially spaced apart from each other along the production casing such that a portion of the annulus extends therebetween and at least the first packer being connected to a sliding sleeve that is disposed on the production cash the sliding sleeve and the first packer being axially movable together along the production casing;

wherein the second packer is fixed to the production casing;

wherein the first and second packers constitute a first pair of packers and further comprising third and fourth packers that together constitute a second pair of packers, the second pair of packers being spaced apart from the first pair of packers along the length of the production casing; both the third and fourth packers being selectively radially expandable away from the production casing to thereby seal an annulus between the production casing and the borehole so as to prevent flow of production fluid therepast, both the third and fourth packers further being selectively radially contractible towards the production casing to unseal the annulus and thereby allow flow of production fluid therepast; wherein the third and fourth packers are axially spaced apart from each other along the production casing such that another portion of the annulus extends therebetween and wherein at least the third packer is connected to a sliding sleeve that is disposed on the production casing, the sliding sleeve and the third packer being axially movable together along the production casing;

wherein the production casing comprises a downhole end, the system further comprising a drilling head that carries out drilling of the underground borehole, the drilling head being located at the downhole end of the production casing;

wherein the sliding sleeve comprises a movable cylinder tube having a first end wall and a second end wall;

a piston disposed in the cylinder tube and fixed to the production casing; and seals at least partially preventing leakage past the piston and the first and second end walls.

9. A system for drilling and completing an underground borehole extending through a plurality of petroleum-bearing formation zones, the system comprising:

a production casing axially extending in the borehole and containing production equipment for producing petroleum from the plurality of petroleum-bearing formation zones;

first and second packers on the production casing, both the first and second packers being selectively radially expandable away from the production casing to thereby seal an annulus between the production casing and the borehole so as to prevent flow of production fluid therepast, both the first and second packers further being selectively radially contractible towards the production casing to unseal the annulus and thereby allow flow of production fluid therepast;

the first and second packers being axially spaced apart from each other along the production casing such that a portion of the annulus extends therebetween, and at least the first packer being connected to a sliding sleeve that is disposed on the production casing, the sliding sleeve and the first packer being axially movable together along the production casing;

wherein the second packer is fixed to the production casing;

wherein the first and second packers constitute a first pair of packers and further comprising third and fourth packers that together constitute a second pair of packers, the second pair of packers being spaced apart from the first pair of packers along the length of the production casing; both the third and fourth packers being selectively radially expandable away from the production casing to thereby seal an annulus between the production casing and the borehole so as to prevent flow of production fluid therepast, both the third and fourth packers further being selectively radially contractible towards the production casing to unseal the annulus and thereby allow flow of production fluid therepast; wherein the third and fourth packers are axially spaced apart from each other along the production casing such that another portion of the annulus extends therebetween and wherein at least the third packer is connected to a sliding sleeve that is disposed on the production casing, the sliding sleeve and the third packer being axially movable together along the production casing;

wherein the production casing comprises a downhole end, the system further comprising a drilling head that carries out drilling of the underground borehole, the drilling head being located at the downhole end of the production casing;

wherein the sliding sleeve comprises a movable cylinder tube having a first end wall and a second end wall;

a piston disposed in the cylinder tube and fixed to the production casing; and seals at least partially preventing leakage past the piston and the first and second end walls;

wherein the seals permit some leakage of hydraulic fluid from the cylinder tube past at least one of the first and second end walls to thereby clean an outside surface of the production casing.

10. A system for drilling and completing an underground borehole extending through a plurality of petroleum-bearing formation zones, the system comprising:

a production casing axially extending in the borehole and containing production equipment for producing petroleum from the plurality of petroleum-bearing formation zones;

first and second packers on the production casing, both the first and second packers being selectively radially expandable away from the production casing to thereby seal an annulus between the production casing and the borehole so as to prevent flow of production fluid therepast, both the first and second packers further being selectively radially contractible towards the production casing to unseal the annulus and thereby allow flow of production fluid therepast;

the first and second packers being axially spaced apart from each other along the production casing such that a portion of the annulus extends therebetween, and at least the first packer being connected to a sliding sleeve that is disposed on the production casing, the sliding sleeve and the first packer being axially movable together along the production casing;

wherein the second packer is fixed to the production casing;

wherein the first and second packers constitute a first pair of packers and further comprising third and fourth packers that together constitute a second pair of packers, the second pair of packers being spaced apart from the first pair of packers along the length of the production casing; both the third and fourth packers being selectively radially expandable away from the production casing to thereby seal an annulus between the production casing and the borehole so as to prevent flow of production fluid therepast, both the third and fourth packers further being selectively radially contractible towards the production casing to unseal the annulus and thereby allow flow of production fluid therepast; wherein the third and fourth packers are axially spaced apart from each other along the production casing such that another portion of the annulus extends therebetween and wherein at least the third packer is connected to a sliding sleeve that is disposed on the production casing, the sliding sleeve and the third packer being axially movable together along the production casing;

wherein the production casing comprises a downhole end, the system further comprising a drilling head that carries out drilling of the underground borehole, the drilling head being located at the downhole end of the production casing;

wherein the sliding sleeve comprises a movable cylinder tube having a first end wall and a second end wall;

a piston disposed in the cylinder tube and fixed to the production casing; and a first cylinder chamber between the production casing, cylinder tube, first end wall and piston and further comprising a second cylinder chamber between the production casing, cylinder tube, second end wall and piston.

11. A system according to claim 10, comprising a first control valve, second control valve and third control valve, each of the first, second and third control valves conveying hydraulic fluid to at least one of the first and second cylinder chambers to thereby cause said movement of the sliding sleeve and packer.

12. A system according to claim 11, comprising a fourth control valve conveying hydraulic fluid to and from the second packer.

13. A system according to claim 12, comprising a hydraulic feeding device that moves the drilling head axially relative to the production casing.

14. A system according to claim 13, wherein the hydraulic feeding device comprises a third cylinder chamber and a fourth cylinder chamber, and further comprising a fifth control valve and a sixth control valve conveying hydraulic fluid to and from hydraulic conduits in the third and fourth chambers, respectively.

15. A method of drilling and completion of an underground borehole extending through a plurality of petroleum-bearing formation zones, the method comprising:

providing a production casing;

providing first and second packers disposed on the production casing, the first and second packers being spaced apart along the production casing by an inter-package distance;

selecting the inter-package distance based on a characteristic of at least one of the plurality of petroleum-bearing formation zones;

axially inserting the production casing into the borehole;

positioning the production casing in the borehole at a location adjacent the at least one of the petroleum-bearing formation zones, wherein both the first and second packers are selectively radially expandable away from the production casing to thereby seal an annulus between the production casing and the borehole so as to prevent flow of production fluid therepast, both the first and second packers further being selectively radially contractible towards the production casing to unseal the annulus and thereby allow flow of production fluid therepast;

operating the first and second packers by expanding the second packer to thereby seal the annulus between the production casing and the borehole so as to prevent flow of production fluid therepast, axially moving the first packer along the production casing, the first packer being spaced apart from the second packer along the production casing; and wherein the first packer is connected to a sliding sleeve that is disposed on the production casing, the sliding sleeve and the first packer being axially movable together along the production casing;

expanding the first packer to thereby seal the annulus between the production casing and the borehole; and contracting the second packer; and thereafter further axially inserting the production casing into the borehole with respect to the first packer and the sliding sleeve;

wherein said operation of the first and second sets of packers seals the at least one formation from remaining formations in the plurality of petroleum-bearing formations during movement of the production casing in the borehole.

16. A method according to claim 15, further comprising operating a drilling head disposed at a downhole end of the production casing to thereby carry out drilling of the underground borehole.

17. A method according to claim 16, comprising operating a traction device to move the drilling head with respect to the production casing.

18. A method according to claim 17, comprising operating an actuator to move the sliding sleeve and second packer with respect to the production casing.

19. A method according to claim 18, comprising coordinating operation of the traction device and sliding sleeves so that drilling and movement of the production casing alternate.

20. A method according to claim 16, further comprising transporting drilling fluid and cuttings from the drilling head to the surface in a return pipe disposed inside the production casing.

21. A method according to claim 18, comprising coordinating operation of the traction device and actuator sliding sleeves so that drilling and movement of the production casing is substantially continuous.

* * * * *